US006615745B2

(12) United States Patent
Cinkaj

(10) Patent No.: US 6,615,745 B2
(45) Date of Patent: Sep. 9, 2003

(54) SHELVING AND ATTACHMENT SYSTEM

(76) Inventor: Chris Cinkaj, 827 Hulmeville Rd., Langhorne, PA (US) 19047

( * ) Notice: Subject to any disclaimer, the term of this patent is extended or adjusted under 35 U.S.C. 154(b) by 0 days.

(21) Appl. No.: 09/838,149

(22) Filed: Apr. 20, 2001

(65) Prior Publication Data

US 2002/0152935 A1 Oct. 24, 2002

(51) Int. Cl.[7] ..... A47B 5/00
(52) U.S. Cl. ..... 108/152; 108/157.1; 211/90.01
(58) Field of Search ..... 108/157.1, 152, 108/144.11, 147.11, 146, 147.16, 151, 23; 211/90.01, 134, 153, 186; 312/111; 11/265.2, 265.3

(56) References Cited

U.S. PATENT DOCUMENTS

| | | | | | |
|---|---|---|---|---|---|
| 1,683,168 | A | | 9/1928 | Dambach | |
| 2,649,350 | A | | 8/1953 | Backus et al. | |
| 3,113,358 | A | | 12/1963 | Zell et al. | |
| 3,333,555 | A | * | 8/1967 | Kapnek | 108/152 |
| 3,347,187 | A | | 10/1967 | Khoury | |
| 3,527,175 | A | * | 9/1970 | Kapnek | 108/152 |
| 3,563,626 | A | | 2/1971 | Ferdinand et al. | |
| 3,645,486 | A | | 2/1972 | Ferdinand et al. | |
| 3,685,465 | A | * | 8/1972 | Haumer | 312/111 |
| 3,717,396 | A | * | 2/1973 | Dupree | 108/161 |
| 3,718,101 | A | | 2/1973 | Sacks | |
| 3,752,088 | A | * | 8/1973 | Kapnek | 108/152 |
| 3,919,950 | A | * | 11/1975 | Frazelle et al. | 108/152 |
| D259,317 | S | | 5/1981 | Gilmore | |
| 4,279,397 | A | | 7/1981 | Larsson | |
| 4,332,205 | A | * | 6/1982 | Corl, Jr. | 108/152 |
| D266,482 | S | | 10/1982 | Goldstein | |
| 4,381,715 | A | * | 5/1983 | Forman | 108/152 |
| 4,589,557 | A | | 5/1986 | Bollmann | |
| 4,886,236 | A | | 12/1989 | Randall | |
| 5,044,285 | A | * | 9/1991 | Wolfe, III | 108/152 |
| 5,097,771 | A | * | 3/1992 | James, III | 108/52 |
| 5,197,703 | A | | 3/1993 | Pratolongo | |
| 5,918,932 | A | * | 7/1999 | Morrison et al. | 108/23 |
| 6,070,536 | A | | 6/2000 | Cinkaj | |
| 6,164,610 | A | * | 12/2000 | Santiago | 211/90.01 |

FOREIGN PATENT DOCUMENTS

| | | | |
|---|---|---|---|
| DE | 3704889 | 8/1988 | |
| EP | 48225 | 3/1982 | |
| FR | 2482507 | * 11/1981 | |
| FR | 550393 | * 12/1992 | 211/90.01 |
| GB | 1326724 | 8/1973 | |
| GB | 2191387 | 12/1987 | |

* cited by examiner

*Primary Examiner*—Lanna Mai
*Assistant Examiner*—Hanh Van Tran
(74) *Attorney, Agent, or Firm*—Richard C. Litman

(57) ABSTRACT

A shelving and attachment system provides for the completely concealed attachment of hollow, built up shelves to a wall or similar structure. The present system may be used for the attachment of a single shelf to a single wall structure, or may be used to secure a series of shelves to a single wall or to two or more adjacent walls. The hollow shelves of the present shelf system preferably include at least one vertical rib therein, extending between the top and bottom panels or surfaces of the shelf for greater structural strength. One or more relatively thin wall mounted cleats, or alternatively, deeper built up cleat boxes for greater shelf support, provide for shelf attachment, with the edges of the shelf box structure fitting over the edges of the cleats. Two or more sides of the shelf structure may be left open, to engage a corresponding number of cleats.

10 Claims, 8 Drawing Sheets

SHELVING AND ATTACHMENT SYSTEM

BACKGROUND OF THE INVENTION

1. Field of the Invention

The present invention relates generally to shelving and support means therefor, and more particularly to built-up shelves having the support or wall attachment means concealed therein when the shelves are installed. The present shelves may be removably or permanently installed stand alone units supported by one or more adjacent wall or panel surfaces, or may comprise built in, plural shelves forming an entertainment system, book shelves, or other shelf systems, as desired.

2. Description of the Related Art

The general concept of using a wall or other generally vertical surface to support an outwardly extending shelf for placement of various articles thereon, is of course well known. Typically, such shelves and shelf systems are supported by two or more exposed brackets or the like, which are secured to the wall and extend outwardly therefrom beneath the shelf. While attempts have been made to beautify such brackets, they are generally unsightly when compared to the remainder of the shelf structure and greatly detract from the appearance of what might otherwise be an attractive article of furniture or shelf installation.

The present inventor is aware of only one previously developed shelf support system for supporting a shelf from a vertical surface and which provides complete concealment for the shelf support means (U.S. Pat. No. 3,718,101 issued to Francis G. Sacks, discussed in detail further below). All other shelf support systems of which the present inventor is aware, either (1) leave the shelf supports exposed in some manner, (2) support the shelf from some other surface than a generally vertical wall(s), or (3) provide concealed wall attachment for an article other than a relatively thin, planar shelf (e.g., wall mounted cabinets, etc.).

Accordingly, a need will be seen for a means of removably or permanently attaching shelving to one or more generally vertical surfaces, while simultaneously completely concealing the shelf attachment means. Such a shelf attachment system must provide sufficient versatility to provide for attachment to one or more walls or panels, either as a single, stand alone shelf or as a group of two or more shelves in an article of furniture or the like (book cases, entertainment centers, etc.). Moreover, the shelf attachment system must also provide for temporarily installable, removable shelving as well as permanently installed shelves, while providing an attractive yet sturdy shelf installation.

A discussion of the related art of which the present inventor is aware, and its differences and distinctions from the present invention, is provided below.

U.S. Pat. No. 1,683,168 issued on Sep. 4, 1928 to Ralph A. Dambach, titled "Adjustable Mantel Shelf," describes a mantel top shelf which is supported by the underlying mantel structure, rather than being supported by one or more cleats extending from the adjacent walls or other vertical panels, as in the present invention. Dambach does not disclose any means of securing his mantel shelf to a generally vertical wall structure, but states only that his shelf "may be fastened upon the mantel or fireplace in the usual manner . . . " (page two, lines 37–39). All of the external edges of the Dambach mantel shelf are finished, and cannot be used to fit over laterally spaced cleats secured to opposed facing walls or panels, as provided by at least one embodiment of the present invention. Moreover, Dambach permanently secures his mantel shelf to the underlying mantel structure and has no motivation to provide for a removable embodiment, as provided by at least one embodiment of the present shelf system invention.

U.S. Pat. No. 2,649,350 issued on Aug. 18, 1953 to Edward D. Backus et al., titled "Foldable Cabinet," describes a box-like cabinet structure having pivotally attached arms at various points and slidably mounted panels at other points, enabling the cabinet to be partially disassembled and folded for storage or transport. This patent also discloses a means of removably attaching the cabinet to a rear wall structure, comprising a vertically spaced apart pair of beveled cleats permanently attached to the wall, with a mating pair of spaced apart cleats having complementary bevels being permanently attached to the back of the cabinet. The cabinet may be lifted slightly to "hook" the cabinet cleats over the wall mounted cleats to support the cabinet on the wall, or may be lifted to remove the cabinet from the wall attached cleats. Such a removable mounting system cannot be used with a relatively thin shelf having only a single cleat attachment pair, as it relies upon the depth of the cabinet or other article to provide the required vertical bracing from below to prevent the article from falling from the upper cleat attachment. While the present invention may make use of complementary beveled cleats for attachment, additional attachment means are also provided to prevent the shelves of the present invention from falling from a single angled cleat attachment.

U.S. Pat. No. 3,113,358 issued on Dec. 10, 1963 to William Zell et al., titled "Supporting Clips," describes a pair of mating clips, with one clip being attached to the mounting structure (wall, etc.) and the other clip being attached to the article to be secured to the mounting structure (shelf, etc.) However, Zell et al. disclose only a single thickness of material to which their clip is attached. That is, they do not show any means of concealing their clips within the interior of a hollow, closed shelf structure, as provided by the present shelf structure invention. Moreover, the Zell et al. wall clip comprises only a pair of relatively thin metal tabs which provide support from only a relatively thin plane defined by the tabs, rather than from the upper and lower edges of a relatively wide cleat, as in the present shelf system invention.

U.S. Pat. No. 3,347,187 issued on Oct. 17, 1967 to Edward F. Khoury, titled "Demountable Shelf," describes a means of mounting cabinets or other relatively vertically deep structures (not relatively thin shelves) on a pair of exposed wall supports. Each wall support includes a series of angled slots, with the cabinets having four laterally spaced brackets with lateral pins extending therefrom, for engaging two vertically separated slots in each wall support. The Khoury system differs substantially from the present invention, in that Khoury requires two laterally spaced, vertically disposed wall supports, whereas the present invention requires only a single horizontal wall cleat, or a series of horizontally coplanar wall cleats on adjacent walls. Moreover, the Khoury wall supports are clearly visible beyond the vertical dimensions of the suspended cabinets, whereas all wall attachments of the present shelves are completely concealed by the shelves.

U.S. Pat. No. 3,563,626 issued on Feb. 16, 1971 to Irwin J. Ferdinand et al., titled "Modular Adjustable Wall Shelving," describes a system similar to the Khoury cabinet support system described immediately above. The Ferdinand et al. system differs in that the vertical supports each have a series of slots therein, into which mating ears or tabs of relatively thin, planar horizontally disposed shelf support arms are secured. The shelves are built up of upper and lower sheets of material, creating a hollow core, into which the horizontal support arms are inserted. While the Ferdinand et al. support arms themselves are concealed, the vertical wall attachments remain exposed.

U.S. Pat. No. 3,645,486 issued on Feb. 29, 1972 to Irwin J. Ferdinand et al., titled "Modular Wall Shelving," describes another system having a pair of vertically disposed, spaced apart tracks providing for the adjustable positioning of one or more shelves thereon. The '486 Ferdinand et al. disclosure differs from the '626 patent to the same inventors, in that a pair of intermediate tracks is removably secured to the vertical structure which is permanently attached to the wall, with shelf supports then being adjustably secured to the removably attached wall tracks. While the permanently attached structure may be concealed with decorative trim, the same points of distinction noted above are seen to apply here as well, i.e., the exposed tracks and exposed lower attachment lugs or fingers which extend from the shelves.

U.S. Pat. No. 3,718,101 issued on Feb. 27, 1973 to Francis G. Sacks, titled "Shelf," describes an assembly having a relatively deep and solid support member which is mechanically or adhesively secured to a wall structure, with a hollow, box-like structure removably installed thereover. Sacks provides no means for positively securing the box-like structure to the support member or to the wall. The only component used in addition to the support block, its wall attachment means, and the box-like cover, is a shim which may be installed between the support block and the box to provide a frictional fit between the block and box. In contrast, the present invention uses one or more relatively shallow cleats, to which the hollow shelf is secured. Accordingly, the present shelf system provides additional stiffening ribs within the hollow shelf, for greater rigidity and strength. The relatively deep mounting block of Sacks precludes the installation of such ribs within the hollow shelf, as the mounting block fills a substantial amount of the internal cavity of the Sacks shelf. Moreover, the Sacks shelf assembly precludes the use of multiple cleat supports on two or more adjacent walls, as provided by at least one embodiment of the present invention. In such a multiple cleat support system, each side of the hollow shelf which is supported by a wall mounted cleat, must be open in order to engage the cleat. The Sacks shelf box is closed along all but one edge, thereby allowing installation on but a single support block extending from a single wall. The opening of other adjacent edges of the Sacks shelf box in order to pass the box over additional mounting blocks on adjacent walls would result in perhaps only a single edge holding the upper and lower surfaces together, thereby weakening the Sacks box structure to the point that it could not support any significant weight. The internal ribs of the present shelf structure, space for which is provided by means of the cooperating shallow mounting cleats, provide sufficient internal strength and tie together the upper and lower shelf surfaces to allow multiple edges of the shelf to remain open for attachment to adjacent cleats mounted on adjacent wall surfaces or panels. In addition to the above noted points of difference, at least one embodiment of the present invention provides for a lighter, hollow wall mount portion, clearly not disclosed or anticipated by Sacks.

U.S. Pat. No. 4,279,397 issued on Jul. 21, 1981 to Frank Larsson, titled "Attachment For Wall Cabinets, Mirrors, Shelves, And Similar Articles," describes a wall mount system comprising two horizontally disposed, spaced apart tracks or grooves which are permanently attached to the wall structure. As such, the Larsson assembly more closely resembles the mounting system disclosed in the '350 U.S. patent to Backus, discussed further above. The Larsson system requires the articles (shelves, cabinets, etc.) to be installed and removed by sliding them (or some form of keeper, which slides into the tracks) onto or from the tracks from the side, thus requiring a clear space at least equal to the width of the wall mounted article. The present system allows the shelves to be installed and removed normal to the primary wall structure, thus precluding any requirement for additional maneuvering space.

U.S. Pat. No. 4,589,557 issued on May 20, 1986 to Armin A. Bollmann, titled "Mounting Means For (Releasably And Movably) Mounting Devices On A Wall, Particularly In Clinics, First Aid Or Surgery Rooms, And The Like; And Manufacturing Method For Said Mounting Means," describes an entire wall structure formed of exposed magnetically attractive plates, with a series of rectilinear slots provided between each of the plates. Articles may be suspended magnetically from the plates, chocked into the trapezoidal slots, or merely hooked on the lips of the slots. The Bollmann system is not closely related to the present invention, due to the exposed suspension or attachment surface and completely different article attachment means provided by Bollmann.

U.S. Pat. No. 4,886,236 issued on Dec. 12, 1989 to Harold M. Randall, titled "Support For Securing A Shelf To A Wall," describes a shelf and support system essentially opposite that of the present invention, in that Randall provides a permanently mounted slotted bracket into which the edge of the relatively thin, single panel shelf is inserted and wedged in place. Thus, the Randall system results in both the upper and lower edges of the support bracket being visible above and below the shelf surface. In contrast, the present system provides a hollow shelf which upper and lower surfaces fit over the wall attachment cleat(s), with the cleat(s) being completely concealed once the overlying shelf is placed thereover.

U.S. Pat. No. 5,197,703 issued on Mar. 30, 1993 to Modesto Pratolongo, titled "Concealed Support Device To Fasten A Shelf To A Wall," describes a relatively complex apparatus for attaching a shelf to a wall structure. Contrary to the title of the Pratolongo patent, the support device is not completely concealed. A permanently attached wall mounting member has an external ridge which is exposed about its periphery, between the abutting edge of the shelf and the wall structure. In contrast, the shelves of the present invention fit completely over the underlying wall attachment cleats to completely conceal those cleats. Moreover, Pratolongo does not disclose any means for supporting his shelves from two or more adjacent walls, as provided by at least one embodiment of the present shelving and attachment system invention.

U.S. Pat. No. 6,070,536 issued on Jan. 6, 2000 to Chris Cinkaj, titled "Decorative Shelving And Method Of Making Same," describes various embodiments of a system for permanently attaching a single shelf to a single wall surface or supporting panel. The primary emphasis of the '536 U.S. patent issued to the present inventor, is the use of complementary beveled edges on the wall mounted cleat and along the internal edges of the hollow shelf structure. These beveled edges require the shelf to be installed either by raising the shelf slightly above the final plane of the completed installation and lowering the shelf onto the cleat while advancing the shelf toward the wall structure, or by sliding the shelf onto the cleat from the side. The placement of the shelf onto the cleat by raising the shelf slightly from its final plane of installation, is not possible for the center or rearmost wall attachment cleat when working with multiple wall cleat support installations. However, the present invention provides for support of one or more shelves by means of multiple adjacent cleats and wall or panel surfaces, and may use such mating beveled support edges for the opposed, parallel support cleats disposed along parallel, laterally opposed wall or support panel structures. The earlier '536 U.S. patent to the present inventor does not anticipate the application of such shelving to multiple adjacent wall surfaces, nor the application of multiple shelves to a series of closely adjacent wall or panel support structures, as found in the construction of bookshelves, entertainment centers, etc.

U.S. Pat. No. D-259,317 issued on May 26, 1981 to Gerald M. Gilmore, titled "Modular Shelving," illustrates a design having an apparently conventional general configuration, with a plurality of horizontal shelf components and vertical supports extending laterally along the edges of the shelves. However, the vertical support walls or panels are apparently formed of a series of spaced apart vertical slats, rather than being continuous panels. No means of securing the Gilmore shelf system to a fixed wall or other vertical panel, is apparent. Moreover, no disclosure is made of any hollow shelf components, as provided by the present system.

U.S. Pat. No. D-266,482 issued on Oct. 12, 1982 to Leonard Goldstein, titled "Combined Shelf Bracket And Wall Support," illustrates a design comprising exposed, vertically disposed and laterally spaced tracks with cooperating bracket members adjustably secured thereto. The tracks have outwardly flared edges, with the brackets having cooperating inwardly turned edges which grip the outwardly flared edges of the tracks. The brackets each have a support arm extending outwardly therefrom, upon which a shelf (not disclosed in the '482 Design patent) may be placed. The Goldstein shelf support design is thus exposed even when a shelf is placed thereon, and more closely resembles other such conventional systems wherein the vertically mounted tracks include a series of slots therein into which mating lugs or ears extending from the shelf support arms are hooked.

British Patent Publication No. 1,326,724 published on Aug. 15, 1973 to James C. Harvey, titled "Improvements In And Relating To The Mounting Of Panel Assemblies, Incorporating Articles of Furniture, On Walls And Floors," describes a wall attachment system incorporating a single, horizontally disposed batten or the like having a downwardly extending bevel facing the wall. A cooperating strip is secured to the back of the cabinet or other structure to be supported. A spacer having a thickness equal to that of the combined wall attachment batten and cabinet attachment member is secured to the back of the structure, to place the back of the structure parallel to the adjacent wall. Only a single wall attachment member is provided; the lower edge or bottom of the structure rests upon the underlying floor or surface. The support structure of the '724 British Patent Publication thus more closely resembles the support structure of the Backus et al. '350 U.S. patent, discussed further above, than the present invention, and in any event, does not provide cantilevered support of the device suspended therefrom, as does the present shelf suspension system.

European Patent Publication No. 48,225 published on Mar. 24, 1982 to MOVI S.n.c., titled "Device And Relevant Complementary Elements For The Suspension Of Furniture Articles To Wall Wood Coverings Composed Of Side-By-Side Panels," describes various embodiments of shelf support brackets which all secure to a chock which is in turn mounted in a vertical slot between adjacent wall panels or boards. The brackets are drawn up by means of screws into the chocks, to secure the brackets immovably in place. One type of bracket comprises an elongate, generally U-shaped device with a long screw extending between the two arms. A shelf having a hollow cutout is then slipped over the bracket to conceal the bracket. However, the shelf disclosed is not constructed of a plurality of relatively thin sheets of material, as is the present hollow shelf. It is also noted that no disclosure is made of any multiple shelf assemblies in the '225 British Patent Publication. Moreover, the system described above using an elongate U-shaped bracket fitting into a hollow pocket in a shelf board, teaches away from the support of a shelf along plural edges thereof as provided by the present shelf attachment system invention, as such elongate brackets extending from mutually orthogonal surfaces would interfere with one another and preclude the installation of a shelf thereon.

British Patent Publication No. 2,191,387 published on Dec. 16, 1987 to Alan J. Marchbanks, titled "Shelves And Supports For Use With Wall Mounted Heating Units," describes a shelf supported by a series of brackets which are wedged between a wall and a steam or hot water radiator placed conventionally near the wall. The solid shelf has a series of sockets formed in the underside thereof, which fit over the upwardly extending ends of the brackets. No means is disclosed for positively attaching the brackets to the wall structure, and moreover, the shelf is a solid component, unlike the present hollow shelf. The brackets are exposed to view beneath the solid shelf, unlike the completely concealed shelf attachment cleats of the present shelf system.

Finally, German Patent Publication No. 3,704,889 published on Aug. 25, 1988 to Bajo Trading Anstalt describes (according to the English abstract and drawings) a two piece bracket, with one piece fastening to the wall structure and a second piece forming an underlying diagonal brace. The part mounted to the wall includes an outwardly extending upper lip, under which the shelf edge is inserted. The diagonal brace portion is bolted to the lower edge of the wall mounted portion. The arrangement more closely resembles that of the British '387 Patent Publication, discussed immediately above, than the present shelf support invention with its hollow shelves and completely concealed attachment means.

None of the above inventions and patents, taken either singularly or in combination, is seen to describe the instant invention as claimed. Thus a shelving and attachment system solving the aforementioned problems is desired.

SUMMARY OF THE INVENTION

The present invention is a shelving and attachment system which provides complete concealment for all shelf support and attachment components, leaving only the shelf itself (and adjacent wall or other vertical panel structure) visible. The present system may be used to form plural shelves secured to one, two, or more adjacent walls or panels, and/or to form shelves at internal and external corners of greater than, equal to, and more than, 90 degrees, thus providing considerably greater versatility than earlier shelf systems of the related art.

The concealed shelf attachment means of the present invention essentially comprises one or more relatively thin cleats which are permanently secured to the wall or other vertical panel where the shelf is to be installed, with a hollow, box-like shelf structure having one or more open sides corresponding to the number of cleats and support walls, being installed to the cleat(s). Alternatively, a "cleat box," comprising a relatively deeper, built-up structure, may be secured to the wall, with the shelf fitting thereover. The upper and lower surfaces and side or edge panels of the shelf structure surround the cleat(s), thereby producing a completely concealed shelf attachment structure. The shelf may be permanently secured (nailed, screwed, etc.) to the concealed cleat(s), or may be removably secured thereto by means of mating gripping edges, threaded fasteners, or other means, as desired.

The interiors of the shelves of the present invention preferably include at least one rib extending between the upper and lower surfaces of the shelf structure, for additional structural strength and support of articles placed thereon. The provision of additional ribs within the hollow shelf structure enables the lateral edge or side panels to be removed as required, for passing the now open sides or edges between the upper and lower surfaces over laterally disposed cleats installed upon facing opposed walls. The laterally opposed cleats and mating shelf edges may include mating bevels or chamfers to provide additional security for the attachment, with the central cleat and shelf edges having a plain cut to allow the shelf edges to fit squarely thereover.

Accordingly, it is a principal object of the invention to provide a shelving and attachment system providing completely concealed shelf attachment means for shelf installations.

It is another object of the invention to provide a shelving and attachment system providing such concealed shelf attachment means for shelves secured to a single wall or panel, as well as for shelves secured to two or more adjacent walls or panels and for shelves secured to internal and external corners of any practicable angle greater than, equal to, or less than 90 degrees.

It is a further object of the invention to provide a shelving and attachment system including at least one hollow, built up shelf structure having at least one support rib therein extending between the upper and lower panels or surfaces of the shelf.

Still another object of the invention is to provide a shelving and attachment system providing for permanent or temporary installation on a wall or panel structure, as desired.

Yet another object of the invention is to provide a shelving and attachment system wherein the wall mounting means may comprise a relatively thin cleat, or may alternatively comprise a built up box structure extending outwardly from the wall or panel.

It is an object of the invention to provide improved elements and arrangements thereof for the purposes described which is inexpensive, dependable and fully effective in accomplishing its intended purposes.

These and other objects of the present invention will become apparent upon review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a shelving and attachment system incorporating one or more hollow, built up shelves which permanently or removably secure to one or more cleats which are in turn permanently secured to a wall structure. The hollow structure of the shelves completely conceals the wall attachment cleats once the shelves are installed, thus providing a clean and attractive appearance which is devoid of underlying braces, brackets, and the like, as found in conventional shelf installations.

Figure 1:
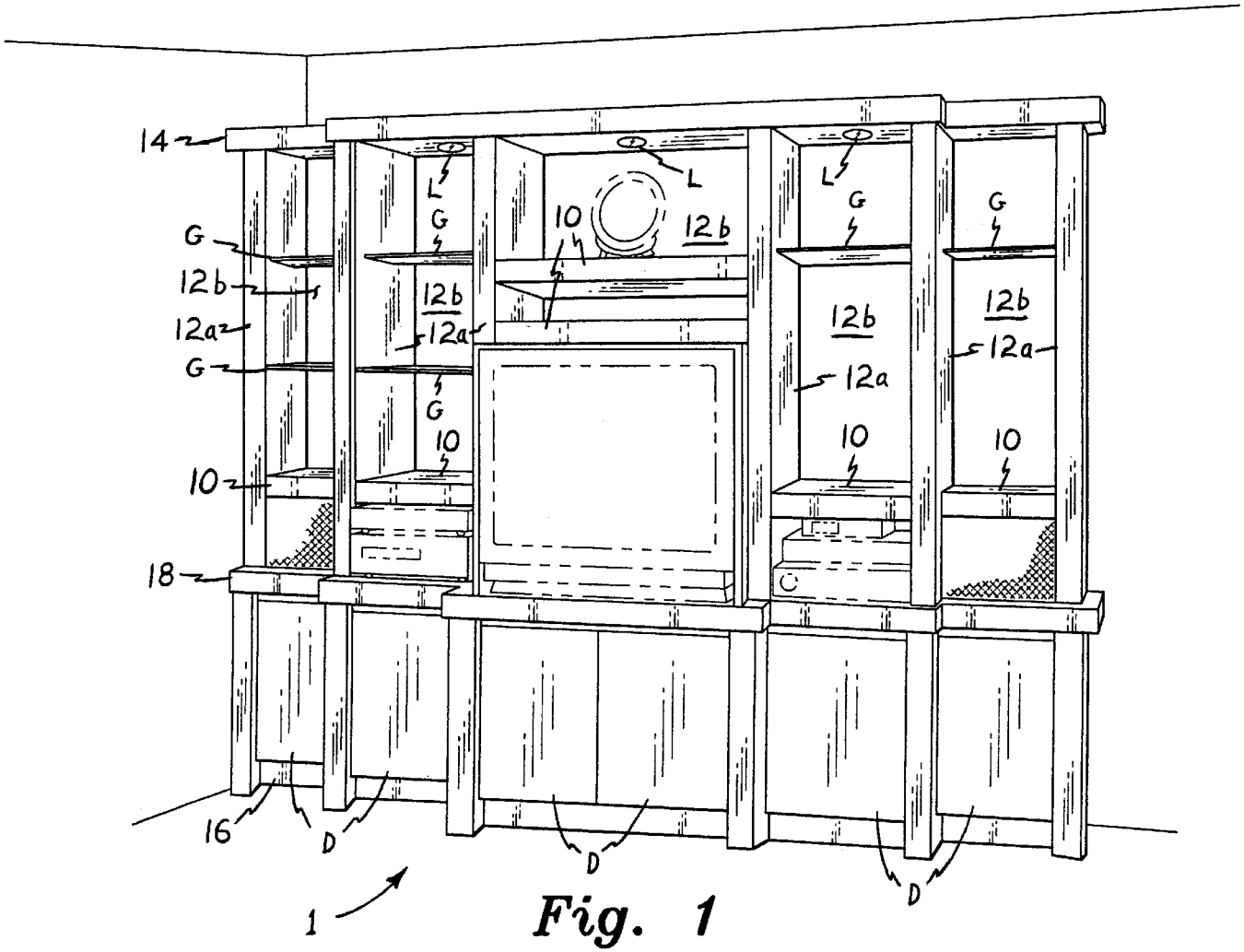
FIG. 1 is a perspective view of a multiple shelf entertainment center incorporating the shelving and attachment system of the present invention.

FIG. 1 illustrates an exemplary multiple shelf construction for an entertainment center 1, utilizing the construction of the present invention. The entertainment center 1 includes a series of horizontal shelves 10 constructed in accordance with the shelf construction of the present invention, with the shelves 10 in turn supported about plural edges by a series of vertical walls 12*a* and a rear wall 12*b*. These shelves 10, as well as larger shelves 14, 16, and 18 noted below, may be installed in different planes as desired, depending upon the installation of their attachment cleats, described in detail further below. The vertical walls and shelves installed therein may be constructed with different depths, as shown in the multiple shelf assembly 1 of FIG. 1. The assembly 1 may include additional features, e.g. glass shelves G, as well as internally recessed lighting means L installed in the hollow interior of an uppermost shelf 14 to illuminate the area below. Doors D may be installed between lowermost and intermediate larger shelves 16 and 18 to provide enclosed cabinets if so desired.

Figure 2:
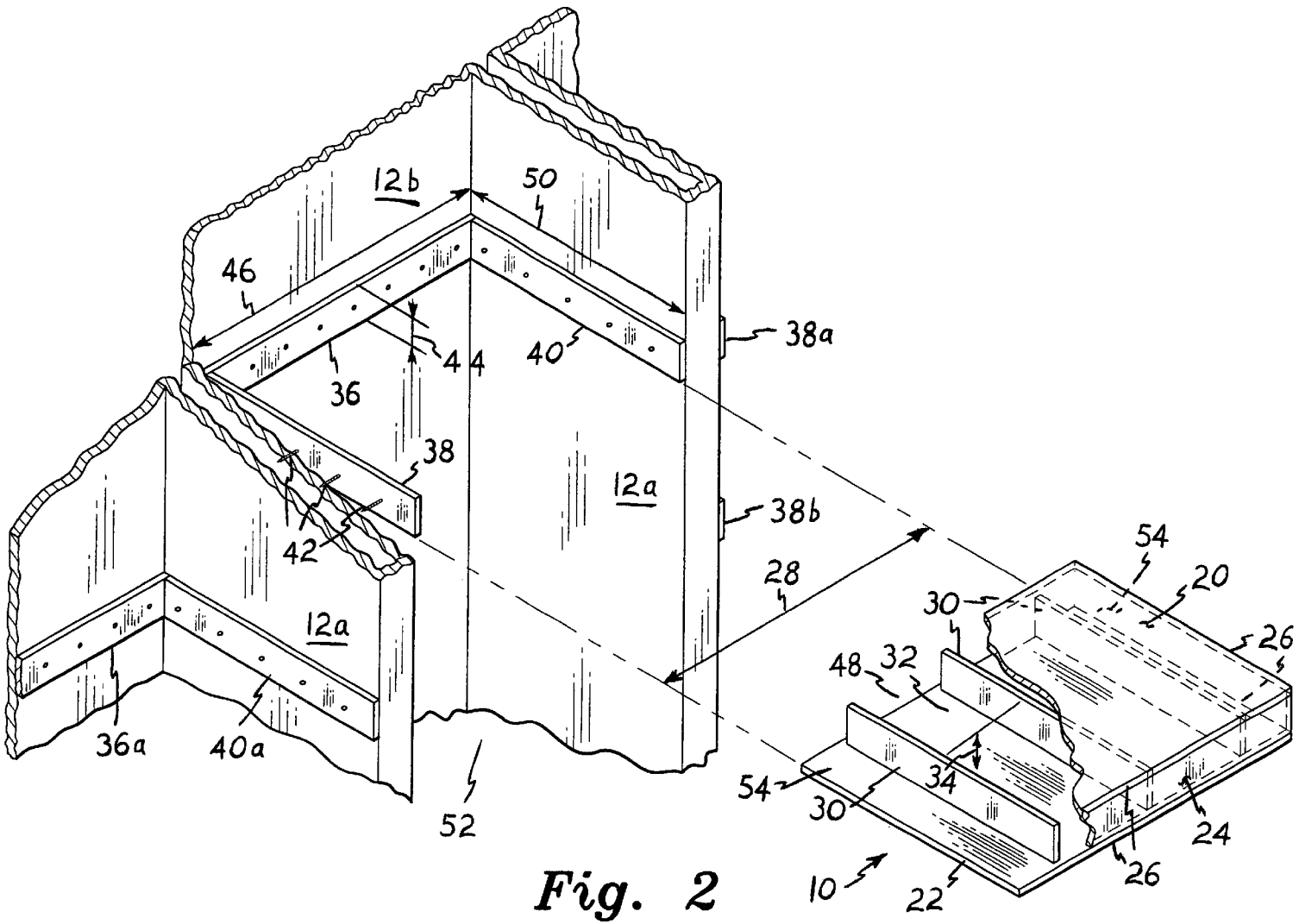
FIG. 2 is a broken away perspective view in partial section of a plural wall and panel structure and mating shelf assembly for installation therewith, showing details thereof.

FIG. 2 provides a detailed illustration of the construction of an exemplary shelf 10 of the present invention, and the means for installing such a shelf 10 to a series of vertical walls. The shelf 10 includes a top panel 20, a bottom panel 22 opposite the top panel 20, and a single edge panel 24 extending between the top and bottom panels 20 and 22. The top and bottom panels 20 and 22 are congruent to one another, with identically configured edges 26 and identical widths 28. Thus, when the assembled shelf 10 is positioned with its top and bottom panels 20 and 22 horizontal, the edge panel 24 (and additional edge panels, if provided) extend in the vertical plane between the corresponding edges 26 of the top and bottom panels 20 and 22 to close that edge of the shelf 10.

This shelf structure, comprising upper and lower panels and at least one edge panel joining the upper and lower panels together, results in a generally hollow structure for the shelf 10 when it is assembled. One or more internal reinforcement ribs 30 may be installed within the hollow interior 32 of the shelf 10, with the height of the ribs 30 defining an internal thickness 34 between the facing surfaces of the top and bottom panels 20 and 22. It will be seen that if the other shelf edges remain open, as shown for the shelf 10 of FIG. 2, the shelf structure would be relatively weak with its single edge connection between the upper and lower panels 20 and 22 provided by the single edge panel 24. The ribs 30 provide the means for securing the top and bottom panels 20 and 22 together along lines other than the single connection edge provided by the single edge panel 24, and provide additional rigidity.

FIG. 2 also illustrates an exemplary multiple wall panel structure to which the shelf 10 is secured. The walls may be hollow or solid, with a pair of parallel, spaced apart walls 12*a* and a rear wall 12*b* joining the two walls 12*a*, as in the general structure of the vertical panels or walls 12*a* and 12*b* of the multiple shelf structure or entertainment center 1 of FIG. 1. The rear wall 12*b* may be an integral part of the building structure into which the present multiple shelf embodiment of the present invention is installed, or may be a component of such a multiple shelf structure constructed as a separate, stand alone structure.

Each wall 12*a* and 12*b* includes a wall shelf attachment cleat, respectively 36 through 40, secured thereto (e.g., screws 42, nails, adhesives, etc.). Each cleat 36 through 40 has a height 44 substantially equal to the shelf internal thickness 34, in order to provide a precise fit for the upper and lower panels 20 and 22 of the shelf 10 over the edges of the cleats 36 through 40. The center or rear cleat 36 preferably has a width 46 which completely spans the distance between the two opposed facing walls 12*a*, thus completely spanning the central open edge 48 of the shelf structure 10. Similarly, the two laterally spaced cleats 38 and 40 have widths or spans 50 extending the depth of the niche 52 defined by the two lateral walls 12*a*, with the shelf 10 having an equal depth along its two lateral open edges 54 to position the closed forward edge 24 flush with the outer edges of the lateral walls 12*a*. It will be seen that the shelf 10 may be modified to have a depth greater or less than the depth 50 of the walls 12*a*, if so desired.

Each cleat 36 through 40 is formed of a thin slat of material (wood, etc.) which may be cut from the same stock as the various panels (particularly the edge panel 24) from which the hollow shelf structure 10 is constructed, and thus has substantially the same thickness as those panels. It is not necessary to provide an excessively deep cleat structure to support the shelf 10 of the present invention, as the support of the shelf 10 along its three open edges 48 and 54 and the internal ribs 30 provide sufficient support.

The shelf 10 is permanently and positively secured to the cleats 36 through 40 by any suitable conventional means, e.g., small countersunk screws, finishing nails, suitable adhesives (wood glue, epoxy, etc.), as desired. U.S. Pat. No. 6,070,536 issued to the present inventor describes such shelf attachment means, with such attachment means incorporated herein by reference. It will be noted that all of the above noted shelf attachment means provide a concealed positive attachment of the shelf 10 to the wall cleats 36 through 40, as the cleats are completely concealed between the top and bottom panels 20 and 22 of the hollow shelf structure 10. Moreover, the mechanical fasteners (countersunk screws or finishing nails) are applied with their driven heads flush with or slightly below the surfaces of the top and bottom panels 20 and 22 of the shelf 10, with any depressions being filled using conventional materials (wood putty, wallboard compound, etc.) and painted or otherwise finished to provide a completely concealed attachment for the shelf 10 to the adjacent supporting wall structure 12*a* and 12*b*.

While only a single shelf assembly 10 is illustrated in FIG. 2, it will be noted that additional wall attachment cleats are shown on the opposite surfaces of the walls 12*a* from the cleats 38 and 40, and on an adjoining rear wall panel 12*b*. The leftmost cleats 36*a* and 40*a* also define a wall shelf attachment plane, just as do the cleats 36 through 40. However, it will be noted that the leftmost cleats 36*a* and 40*a* are not coplanar with the cleats 36 through 40, but define a second shelf plane or level below the plane or level defined by the central cleats 36 through 40. The present wall shelf attachment system allows shelves (e.g., shelf 10) to be installed at any level desired on the walls 12*a* and 12*b*, depending upon the level at which the supporting cleats are installed. Moreover, the shelf support cleats may be installed at multiple levels on the walls to define a plurality of different shelf attachment planes or levels, as shown by the cleats 38*a* and 38*b* which ends are visible on the right hand wall 12*a* in FIG. 2. The multiple shelf entertainment center 1 of FIG. 1 clearly illustrates a completed structure incorporating such cleat placement, providing for multiple shelves positioned at a plurality of different levels in the structure.

Figure 3:
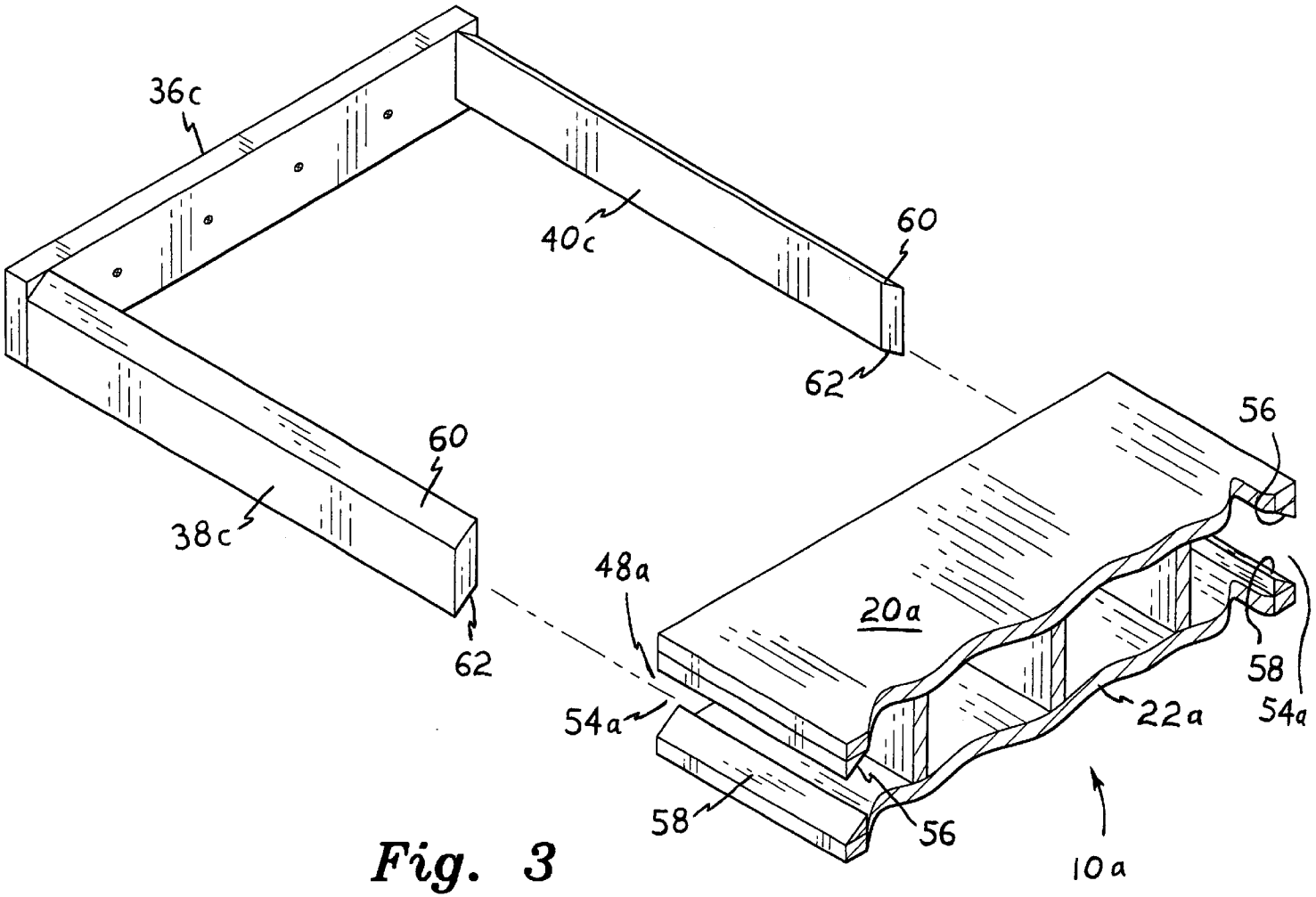
FIG. 3 is a simplified perspective view of only the wall cleats and part of a corresponding shelf assembly for installation thereon, showing beveled edges on opposed cleats and shelf edges.

FIG. 3 illustrates a variation on the cooperating shelf and wall attachment cleat configuration illustrated in FIG. 2. In FIG. 3, the shelf assembly 10*a* includes upper and lower bevels, respectively 56 and 58, secured respectively to the upper and lower panels 20*a* and 22*a* along each of the open lateral edges 54*a* of the shelf 10*a*. The corresponding lateral cleats 38*c* and 40*c* each have an upper and a lower edge with complementary bevels, respectively 60 and 62, along which the bevels 56 and 58 of the shelf lateral edges 54*a* fit. (The associated walls to which the cleats 36*c* through 40*c* would be attached are not shown in FIG. 3, for clarity in the drawing Figure.)

The slopes of the beveled faces 56 through 62 along each lateral edge of the shelf 10*a* are identical, i.e., they each slope downwardly and outwardly away from the center of the shelf assembly 10. The remaining central or rear cleat 36*c*, as well as the open central edge 48*a* of the shelf assembly 10*a*, are unbeveled to allow the shelf 10 to install straight onto the rear cleat 36*a* without interference from any angularly beveled edges along the mating central edges thereof. This configuration enables the shelf assembly 10*a* to be installed upon the cleats 36*a* through 40*a* by slipping the shelf 10*a* over the two beveled lateral cleats 38*a* and 40*a*, with the beveled edges 56 through 62 interlocking to provide a positive fit for the shelf 10*a* with the lateral cleats 38*c* and 40*c*. The downward and outward angle of the upper bevels 56 and 60, tends to urge the lateral cleats 38*c* and 40*c* together, thereby providing an even more secure fit for the shelf 10*a*, rather than tending to wedge the opposed cleats 38*c* and 40*c* (and their associated walls) apart, as would be the case if the bevel angles were reversed. It will be seen that this mating beveled edge configuration may be used with permanently installed shelving, or may alternatively be used to support removably installed shelves which are merely slid into position as desired.

Figure 4:
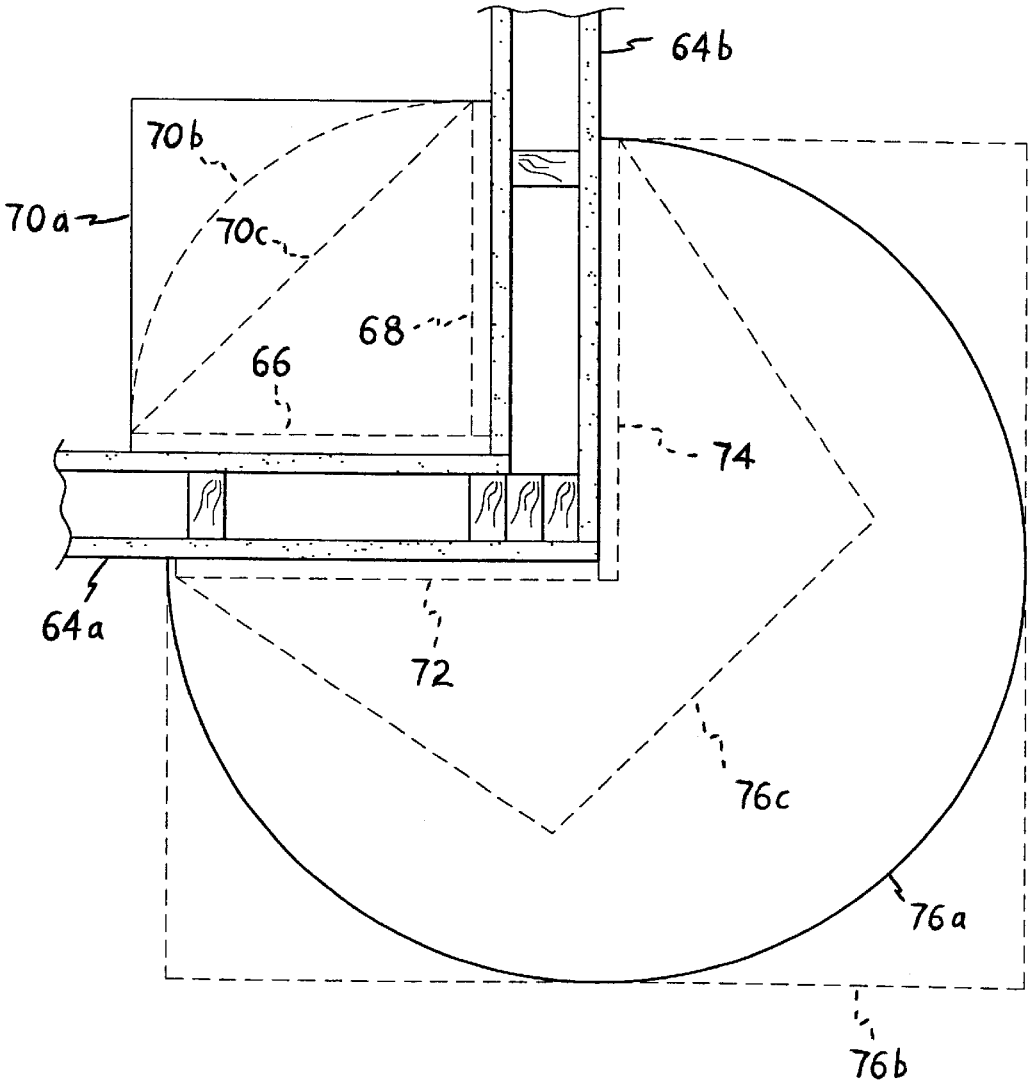
FIG. 4 is a top plan view of a 90 degree corner, showing the installation of various planforms of shelves installed thereon and therein according to the present shelf system invention.
Figure 5:
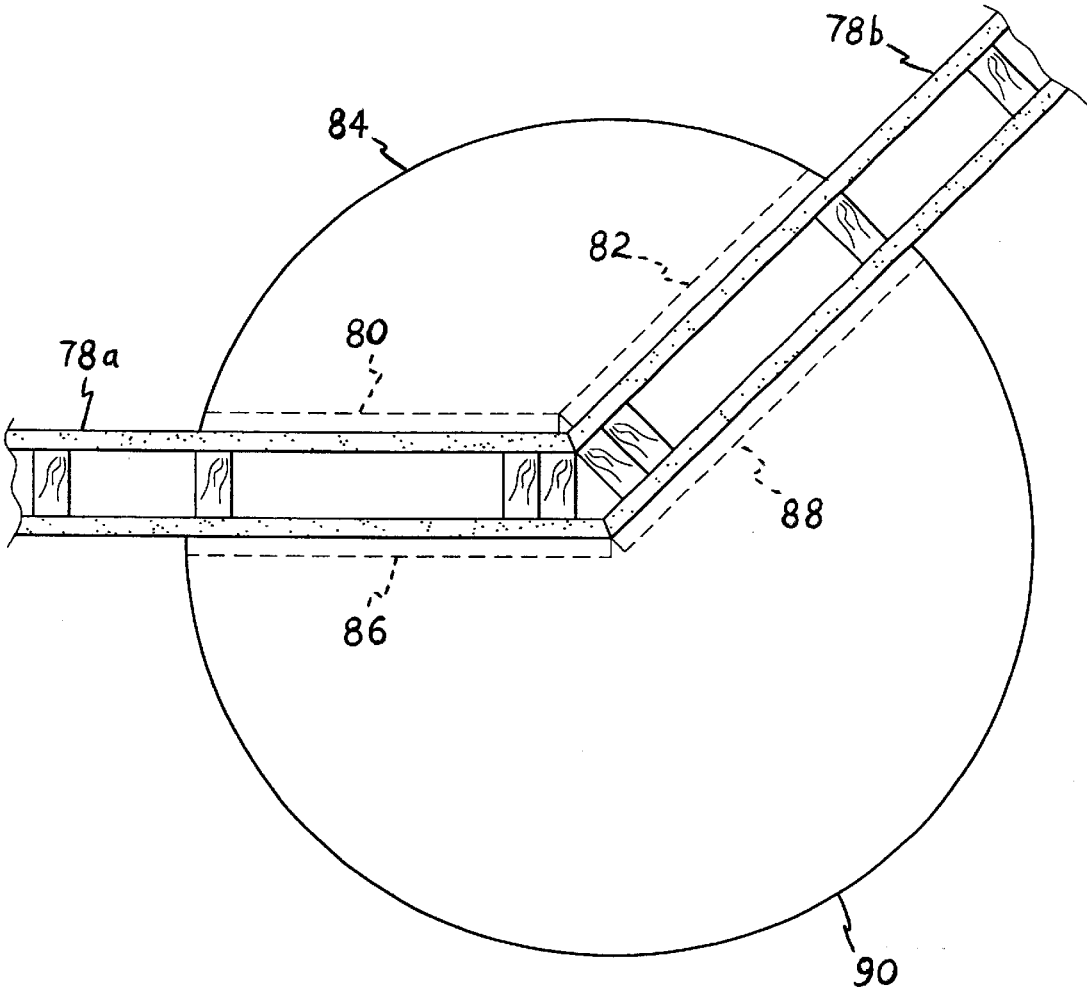
FIG. 5 is a top plan view similar to that of FIG. 4, but showing a corner of other than 90 degrees.

FIGS. 4 and 5 of the drawings illustrate top plan views of various shelf and wall configurations which may be constructed according to the present invention. FIG. 4 illustrates a wall structure wherein two adjacent, angularly displaced walls 64*a* and 64*b* have an included angle of substantially 90 degrees therebetween, with an external angle of substantially 270 degrees. The present shelf system provides for the removable or permanent installation of shelves of any practicable planform at such internal and external corners, as desired.

The upper left portion of FIG. 4 illustrates a pair of adjacent wall attachment cleats 66 and 68 (shown in broken lines, as they would be concealed within the shelf structure) secured to the internal corner, with various shelf configurations secured thereto. A first shelf configuration 70*a* comprises a generally square shape, with a second configuration 70*b* (shown in broken lines, as an alternative shape) having a quarter circular planform and a third configuration 70*c* (in broken lines) having a triangular plan. It will be seen that these three shapes are exemplary, and that virtually any practicable shape may be used to form such an internal corner shelf according to the present invention.

The lower right portion of FIG. 4 discloses a pair of wall attachment cleats 72 and 74, secured to the external corner of the walls 64*a* and 64*b*. As in the case of the different shelf configurations 70*a* through 70*c*, the external shelves may have any practicable shape, e.g., the ¾ circular shape 76*a*, square shelf 76*b*, trapezoidal shelf shape 76*c*, etc., as desired.

FIG. 5 illustrates the installation of shelves according to the present invention at the internal and external corners of an adjacent wall pair 78*a* and 78*b* having internal and external angles of other than 90 degrees. In FIG. 5, a first wall 78*a* and a second wall 78*b* meet at an included angle of somewhat more than 90 degrees, with an external angle of somewhat less than 270 degrees. It will be seen that the present invention is also operable with corners having included angles of less than 90 degrees and external angles of greater than 270 degrees. A pair of internal corner wall attachment cleats 80 and 82 are secured to the two walls 78*a* and 78*b*, adjacent their internal corner. A shelf 84 is then secured thereto, as shown in FIG. 5. The external corner has first and second external corner cleats 86 and 88 secured adjacent thereto, with an external corner shelf 90 secured to the cleats 86 and 88.

While the two shelves 84 and 90 illustrated in FIG. 5 each have semicircular arcuate planforms, it will be seen that any practicable shape may be used for such shelves, in keeping with the present invention. Such corner shelves will always have two open edges corresponding to the two wall attachment cleats of each internal and external corner, with an additional one or more closed, exposed edges, depending upon the specific geometric shape of the shelf provided. In the case of shelves having semicircular external shapes, a single ply of edge material may be curved to fit about the peripheral ends of a series of internal ribs (not shown, but similar to those disclosed in FIGS. 2 and 3) to form the desired shape.

Figure 6:
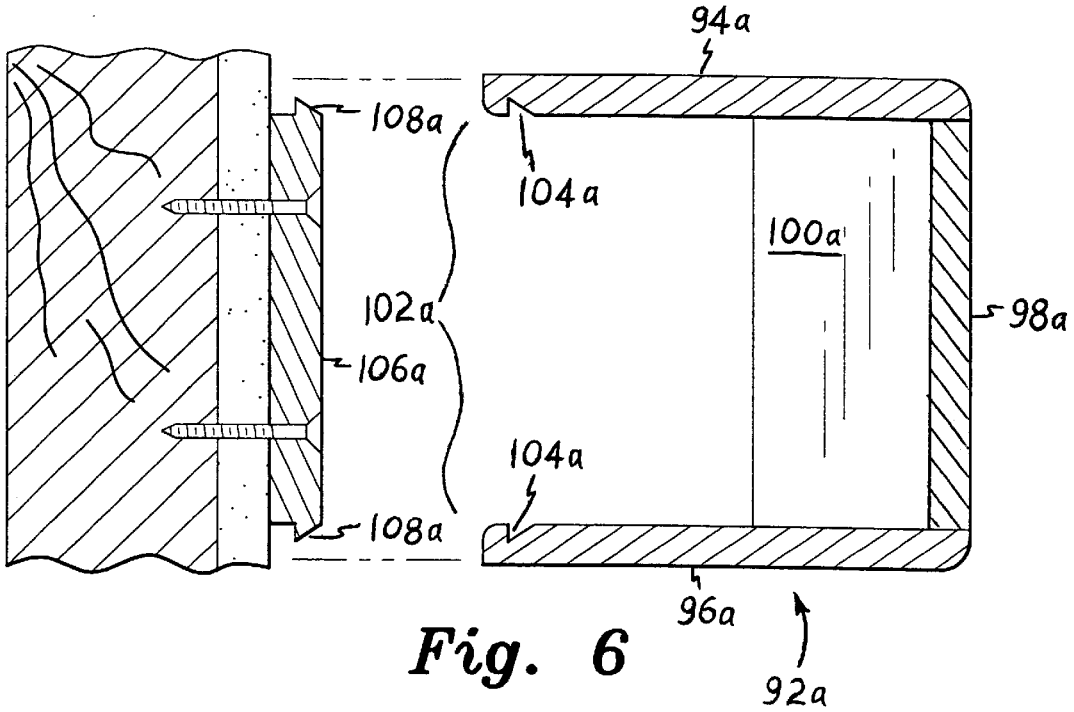
FIG. 6 is a detailed side elevation view in section, showing a removable shelf embodiment.
Figure 7:
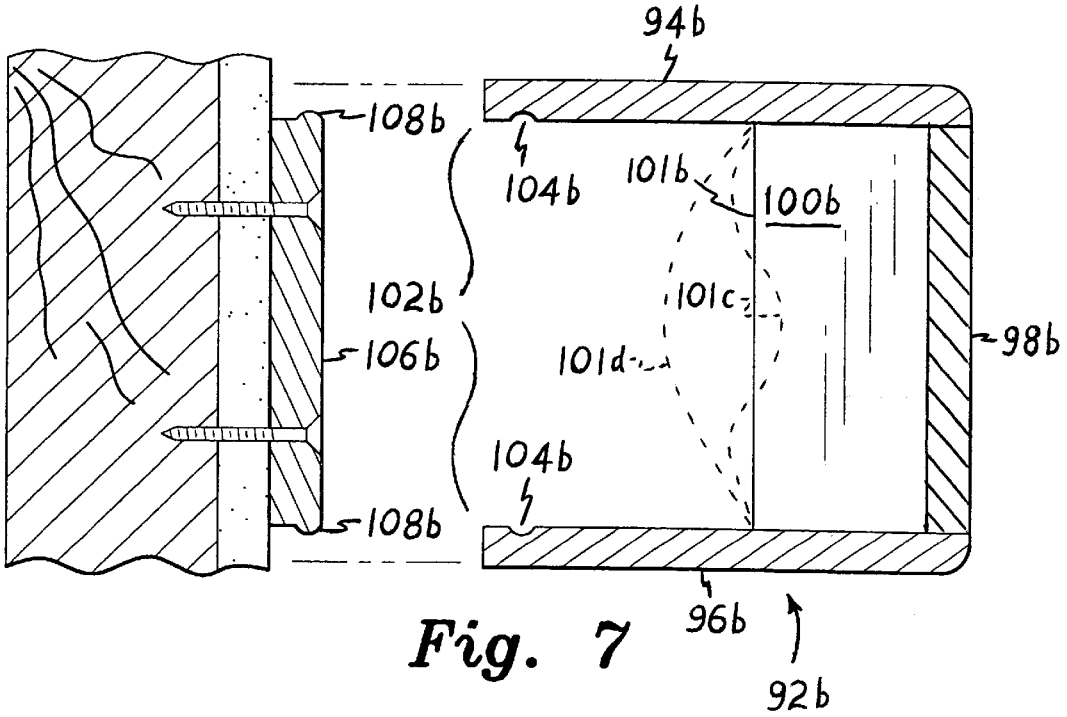
FIG. 7 is a view similar to that of FIG. 6, showing an alternative removable shelf attachment embodiment.

To this point, the disclosure has been primarily directed to permanently installed shelf embodiments. However, it will be noted that the present invention lends itself to temporary, removable installation for shelves as well. FIGS. 6 and 7 provide side elevation views in section of a pair of related shelf attachment systems providing for removable attachment of a shelf to a wall attachment cleat in accordance with the present invention.

FIG. 6 illustrates a sectional elevation view of a shelf assembly 92*a*, having a top panel 94*a*, opposite bottom panel 96*a*, outer edge panel 98*a*, and at least one internal rib 100*a*. The open cleat attachment side 102*a* of the shelf 92*a* has a slot 104*a* formed along the internal cleat attachment edge of the upper and lower panels 96*a* and 98*a*. The mating wall attachment cleat 106*a* has a periphery with ridges 108*a* formed along the upper and lower edges thereof, with the cleat ridges 108*a* having a complementary shape to the internal slots 104*a* of the shelf open end 102*a*. The ridges 108*a* may be provided with a relatively sharp, sawtooth shape, as shown, with the mating slots or grooves 104*a* having complementary shapes, to provide for the positive attachment of the shelf 92*a* to the mating cleat 106*a*. It will be noted that the attachment means comprising the wall cleat 106*a* and the mating cleat ridges 108*a* and shelf slots or grooves 104*a*, are completely concealed when the shelf assembly 92*a* is secured to the cleat 106*a*. The shelf 92*a* is easily removed by flexing the attachment ends of the upper and lower panels 94*a* and 96*a* slightly apart, with the relatively short rib 100*a* leaving the attachment ends of the panels 94*a* and 96*a* free.

FIG. 7 illustrates another variation on the shelf attachment embodiment of FIG. 6, with the essential difference residing in the specific shape of the attachment ridges and slots of the two components. The shelf 92*b* of FIG. 7 is formed essentially of upper and lower panels 94*b* and 96*b*, an outwardly disposed closed end or edge panel 98*b*, and at least one internal rib 100*b*. The cleat attachment end or edge 102*b* of the shelf assembly 92*b* includes a slot 104*b* formed along the inner lip or edge thereof on each panel 94*b* and 96*b*, generally as in the shelf embodiment of FIG. 6. The mating wall attachment cleat 106*b* includes mating ridges or protuberances 108*b* formed along the upper and lower edges of its periphery, configured to mate securely with the complementary slots or grooves 104*b* of the shelf assembly 92*b*.

The internal reinforcing rib 100*b* of the shelf assembly 92*b* of FIG. 7 also shows various alternative configurations. While the primary shape of the rib 100*b* is rectangular with a straight free or unattached edge 101*b*, it will be seen that it may have other shapes for its free or unattached edge, e.g., the convex curved edge 101*c* or the sinusoidal edge 101*d*, as desired. Other shapes or configurations may be applied to the internal ribs of any of the shelves of the present invention, as desired. These free or open edge configurations are not critical, so long as they do not engage the cleat structure secured to the panel to which the shelf is to be secured. It will be seen that a mating shape or configuration may be applied to the corresponding panel attachment cleat, if so desired.

The primary distinction between the shelf assembly 92*a* of FIG. 6 and the assembly 92*b* of FIG. 7, is in the shape of the internal cleat attachment slots or grooves. In FIG. 7, the slots or grooves 104*b* have a concave semicircular or rounded shape, with the mating ridges 108*b* of the cleat 106*b* having a complementary convex shape. These smoothly rounded, semicircular shapes 104*b* and 108*b* enable the shelf assembly 92*b* to be removed more easily from its mating wall attachment cleat 106*b*, with the flexible upper and lower panels 94*b* and 96*b* spreading slightly as the ends 102*b* of the panels ride up and over the mating rounded ridges 108*b* of the cleat 106*b*. Other mating, complementary shapes may be provided as desired to secure a shelf assembly to a mating wall attachment cleat, in accordance with the present invention.

Figure 8:
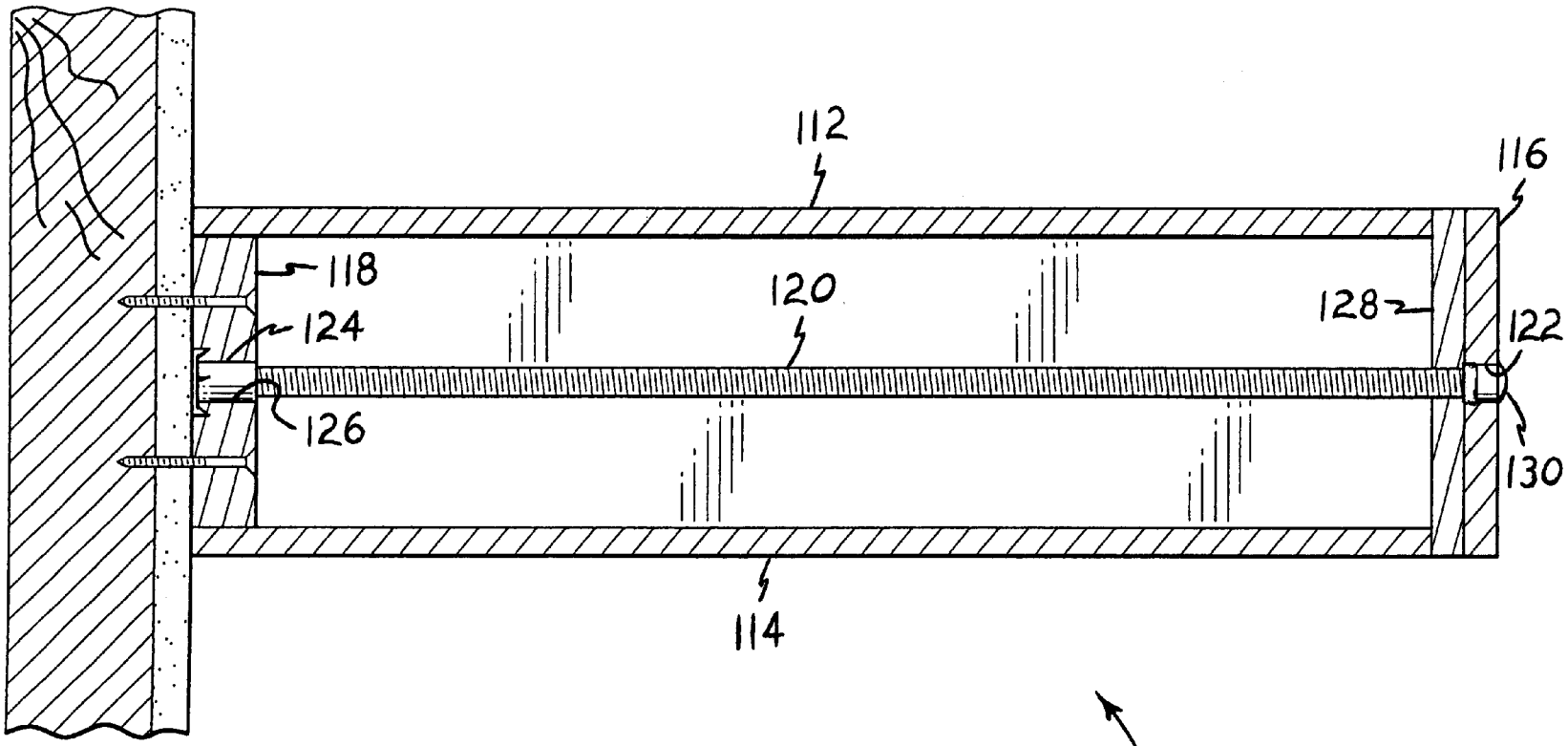
FIG. 8 is a side elevation view in section showing yet another removable shelf attachment embodiment.

FIG. 8 illustrates yet another means for securing a built up shelf assembly to a mating wall attachment cleat in accordance with the present invention. FIG. 8 discloses a side elevation view in section of another embodiment of the present shelf and attachment system, with the shelf assembly being designated by the reference numeral 110. The shelf assembly 110 is formed of a top panel 112, an opposite bottom panel 114, and a closed, outwardly disposed end panel 116. The shelf assembly 110 engages a wall attachment cleat 118 which is permanently secured to a wall structure, in the manner of other embodiments of the invention discussed further above.

However, the shelf 110 utilizes mechanical fastening means for attachment to the mating wall cleat 118. A threaded mechanical fastener 120 (elongate bolt or screw) passes through a passage 122 formed through the end panel 116, and engages a mating internally threaded fastener 124 (tee nut, etc.) installed in a passage 126 formed through the cleat 118. The tee nut 124 (or other fastener) is installed from the back side of the cleat 118 before securing the cleat 118 to the wall, with the shelf 110 then being secured to the cleat 118 by threading the fastener 120 into the mating female fastener 124 anchored through the back of the cleat 118. An end panel doubler 128 may be provided to resist the compressive force as the fastener 120 is tightened, with a decorative end cap 130 being provided to conceal the otherwise exposed end of the fastener 120. Other mechanical fastening means (cam locks, anchor nuts, etc.) may be used as desired in lieu of the tee nut illustrated, to provide removable or permanent attachment for the shelf 110.

Figure 9:
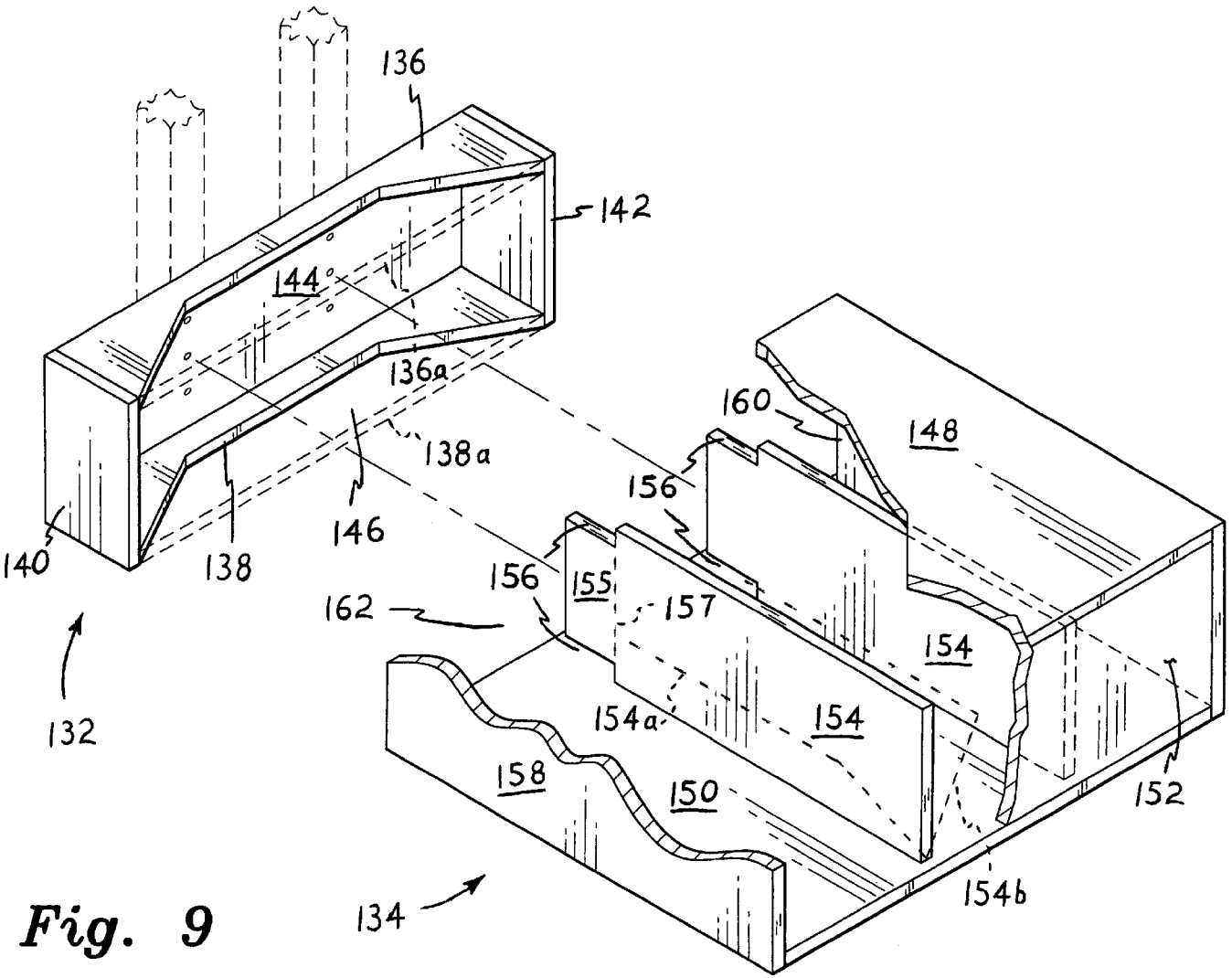
FIG. 9 is a perspective view in partial section, illustrating an alternative wall attachment structure comprising a relatively deep, built up cleat box and shelf structure therefor.

To this point, the wall attachment cleat has been described as a single, relatively thin, unitary component having a thickness substantially the same as that of the top, bottom, and end panel components or sheets used to form the built up shelf structure. However, other wall cleat configurations may be provided, as well. FIG. 9 illustrates such a built up wall cleat 132, and also shows a built up shelf structure 134 having only a single open cleat attachment side. The cleat 132 of FIG. 9 is essentially built up of a top cleat panel 136, an opposite bottom cleat panel 138, opposite first and second cleat end panels 140 and 142, and a cleat back or wall attachment panel 144, which components form a built up cleat box 132 having an open front or face area 146 when assembled.

The top and bottom panels 136 and 138 are cut back in their center areas, as these areas are not critical for structural strength. However, they may be formed of straight, rectangular panels if so desired, as shown by the broken line edges 136*a* and 138*a* for the cleat box structure 132. Also, while the two end panels 140 and 142 do not extend appreciably outwardly from the back wall attachment panel 144, they may be made deeper if desired, with the connecting ends of the top and bottom panels 136 and 138 having corresponding depths. It should also be noted that while only a single cleat structure 132 is shown in FIG. 9, similar additional cleat box structures may be formed for adjacent walls, essentially in the same arrangement as that shown for the cleats 36 through 40 of FIG. 2. Alternatively, such a multiple wall cleat assembly may be constructed as a single, unitary structure if desired.

The built up shelf 134 of FIG. 9 has a similar construction to the shelves 10 and 10*a* of FIGS. 1 through 3, with a top panel 148, opposite bottom panel 150, outwardly disposed shelf edge panel 152, and (optionally) one or more internal ribs 154. Each rib 154 includes upper and lower relief cutouts 156 at their cleat box mating ends, to provide clearance for the outwardly extending upper and lower cleat box panels 136 and 138 which fit within the relief cutouts 156 between the ribs 154 and outer top and bottom panels 148 and 150 of the shelf box 134. (It should also be noted that the ribs 154 of the shelf 134, as well as any internal ribs of other shelf structures of the present invention, are cut slightly shorter than the depth of the upper and lower panels of the shelf structure to provide clearance for the thickness of the wall attachment cleat or wall attachment portion of a built up cleat.)

Alternatively, the nose portions 155 of the ribs 154 which would extend into the cleat box 132 may be eliminated, if so desired, by cutting the ribs 154 along the broken line 157, in order to simplify construction. However, the extended nose portions 155 provide additional strength and rigidity for the shelf 134 and built up cleat box assembly 132, when retained, and may be desirable in many, if not most, such built up cleat and corresponding shelf assemblies.

To this point, all of the internal rib assemblies for the various built up shelf configurations have been illustrated as being perpendicular to the upper and lower shelf panels or surfaces. However, it will be seen that these internal reinforcing ribs may be installed to form other than right angles with the upper and lower panels, if so desired. Such alternative angles are shown for one of the ribs 154 of the shelf structure 134 of FIG. 7, as alternative, diagonally disposed rib positions 154*a* and 154*b*. Such angularly installed ribs 154*a*, 154*b*, etc. may provide some additional strength by triangulating the structure to some extent. Also, it will be noted that the ribs 154 (or others of other embodiments of the present invention) may be installed to form other than right angles to the wall panel to which the shelf is to be attached. This would be particularly applicable to such non-square configurations as the shelves 70*b*, 70*c*, 76*a*, and 76*c* of FIG. 4, and shelves 84 and 90 of FIG. 5.

The shelf structure 134 of FIG. 9 also differs in that it includes opposite first and second lateral edge panels 158 and 160, in addition to the outwardly disposed front edge panel 152. This results in the shelf 134 of FIG. 9 having three closed sides defined by the front and lateral edge panels 152, 158, and 160, and only a single open edge face 162 for mating with the corresponding single built up wall cleat 132. However, it will be seen that the lateral edge panels 158, 160 may be omitted to permit installation of the shelf 134 with multiple wall cleat structures of any type, if so desired, and conversely, such lateral edge panels may be applied to other shelves of the present invention for their use with single cleat installations on single walls.

In conclusion, the present shelving and attachment system provides several embodiments of shelf construction and installation for use in single, isolated shelf installations or as components of multiple shelf installations in stand alone shelf assemblies or as built in shelf assemblies. One of the common themes and advantages provided by the present invention is the complete concealment of all shelf attachment means within the internal space of the built up shelf, whether the shelf is permanently or removably installed. Another advantage provided by the present invention is the forming of the wall attachment cleats from either single boards or panels of relatively thin stock, having a thickness substantially the same as that used for the various components in constructing the built up shelves of the present invention. This provides a significant savings in material, as the cleat materials may be cut from the same stock thickness as that used for the shelf components.

The present shelving and attachment system provides great versatility in shelf installations, being adaptable to single and multiple wall installations as well as internal and external corners having virtually any angle therebetween. The present shelves may be formed to have any practicable regular or irregular geometric shape, as desired. Accordingly, the present shelving and attachment system invention will find widespread popularity in the construction of various articles of furniture using shelves therein (book cases, entertainment centers, etc.) as well as for built in shelf construction in homes, offices, and any location where the craftsmanship of the present invention is valued.

It is to be understood that the present invention is not limited to the embodiments described above, but encompasses any and all embodiments within the scope of the following claims.

I claim:

1. A shelving and attachment system for attaching at least one shelf to at least two adjacent and angularly displaced walls, comprising:

at least one shelf top panel, at least one shelf bottom panel, and at least one shelf edge panel, forming at least one generally hollow shelf when assembled together;

said at least one shelf top panel and said at least one shelf bottom panel each having a panel width congruent to one another, and a plurality of edges corresponding to one another;

said at least one shelf edge panel extending between at least one of said edges of said at least one shelf top panel and the corresponding at least one of said edges of said at least one shelf bottom panel, and defining a corresponding at least one closed edge;

said at least one shelf top panel and said at least one shelf bottom panel defining an internal shelf thickness therebetween;

at least two wall attachment cleats each secured respectively to one of the at least two walls;

said at least two cleats having heights substantially equal to said internal shelf thickness;

said at least one shelf further including at least two open edges corresponding to said at least two cleats, with each of said open edges having a width;

each of said cleats further having a width corresponding to said width of a corresponding one of said open edges of said at least one shelf;

each of said cleats further having a top cleat panel, a bottom cleat panel, mutually opposed first and second end cleat panels, a cleat attachment panel, wherein said top cleat panel, said bottom cleat panel, said end cleat panels, and said cleat attachment panel comprise an open faced cleat box when assembled together; and concealed positive attachment means securing said at least two open edges of said at least one shelf to said at least two cleats and completely concealing said cleats when said at least one shelf is attached thereto.

2. The shelving and attachment system according to claim 1, wherein:

said at least two wall attachment cleats comprises a plurality of said wall attachment cleats attached to the adjacent walls and defining a plurality of shelf planes; and said at least one shelf comprises a plurality of shelves formed from a corresponding plurality of shelf top panels, shelf bottom panels, and shelf edge panels.

3. The shelving and attachment system according to claim 2, further including:

door means disposed between at least two of said shelves secured to at least two of said wall attachment cleats defining at least two different said shelf planes; and lighting means disposed within at least one of said shelves for selectively illuminating the area therebelow.

4. The shelving and attachment system according to claim 1 wherein:

the at least two adjacent and angularly displaced walls comprise spaced apart opposite first and second walls with a third wall extending therebetween and defining a shelf niche therein;

said at least two cleats comprises a plurality of said wall attachment cleats attached to the first, second and third walls and defining at least one shelf plane;

said at least one shelf comprises a plurality of shelves formed from a corresponding plurality of shelf top panels, shelf bottom panels, and shelf edge panels; and each of said shelves has first, second and third open edges corresponding to the first, second and third walls and fitting over said wall attachment cleats attached thereto.

5. The shelving and attachment system according to claim 4, wherein:

said plurality of wall attachment cleats define a plurality of shelf planes; and said plurality of shelves are disposed in a plurality of shelf planes, being attached to said wall attachment cleats.

6. The shelving and attachment system according to claim 1, wherein:

said at least one shelf top panel, said at least one shelf bottom panel, and said at least one shelf edge panel are each formed of a sheet of material having a small thickness; and each of said cleats is formed of material having a thickness substantially equal to said thickness of said at least one shelf top panel, said at least one shelf bottom panel, and said shelf edge panel of said at least one shelf.

7. The shelving and attachment system according to claim 1, further including at least one reinforcement rib disposed within said internal shelf thickness and between said at least one shelf top panel and said at least one shelf bottom panel of said at least one shelf.

8. The shelving and attachment system according to claim 1, wherein said concealed positive attachment means comprises mechanical fasteners securing each of said open edges of said at least one shelf to a respective one of said cleats.

9. The shelving and attachment system according to claim 1, wherein said concealed positive attachment means comprises:

each of said cleats and said at least one shelf each respectively having mating peripheral and internal contact edges;

a slot formed peripherally along at least a portion of said peripheral contact edges of each of said cleats;

a ridge formed along at least a portion of said internal contact edge of said at least one shelf; and said slot and said ridge removably engaging one another for attaching said at least one shelf to each of said cleats.

10. The shelving and attachment system according to claim 1, wherein said concealed positive attachment means comprises:

first mechanical fastener means disposed through one of said cleats;

second mechanical fastener means disposed through said at least one shelf, for removably engaging with said first mechanical fastener means of said one of said cleats; and means for concealing said second mechanical fastener means of said at least one shelf.

* * * * *